US008491084B2

(12) United States Patent
Sato et al.

(10) Patent No.: US 8,491,084 B2
(45) Date of Patent: Jul. 23, 2013

(54) INK JET RECORDING APPARATUS

(75) Inventors: Osamu Sato, Takasaki (JP); Riichi Saito, Fujisawa (JP); Noribumi Koitabashi, Yokohama (JP); Nobuyuki Kuwabara, Hachioji (JP); Tsuyoshi Kanke, Yokohama (JP); Koichiro Nakazawa, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 176 days.

(21) Appl. No.: 12/879,900

(22) Filed: Sep. 10, 2010

(65) Prior Publication Data

US 2011/0063366 A1 Mar. 17, 2011

(30) Foreign Application Priority Data

Sep. 15, 2009 (JP) ..... 2009-213338

(51) Int. Cl.
*B41J 2/165* (2006.01)

(52) U.S. Cl.
USPC ..... 347/22; 347/33; 347/92

(58) Field of Classification Search
None
See application file for complete search history.

(56) References Cited

U.S. PATENT DOCUMENTS 4,658,272 A * 4/1987 Toganoh et al. ..... 347/42
2005/0122360 A1 6/2005 Sakagami et al.
2009/0213168 A1 * 8/2009 Ito ..... 347/19

FOREIGN PATENT DOCUMENTS

JP 9-011496 A 1/1997

* cited by examiner

*Primary Examiner* — Matthew Luu
*Assistant Examiner* — Justin Seo
(74) *Attorney, Agent, or Firm* — Canon USA Inc. IP Division

(57) ABSTRACT

An inkjet recording apparatus efficiently recovers defective discharge while reducing the amount of waste ink, acquires position information of a defective discharge nozzle and, based on the position information, determines whether the defective discharge has been caused by a bubble or a dust particle, and selects an ink circulation mode or a wiping mode.

11 Claims, 10 Drawing Sheets

INK JET RECORDING APPARATUS

BACKGROUND OF THE INVENTION

1. Field of the Invention

The present invention relates to a cleaning technique of an ink jet recording head.

2. Description of the Related Art

Ink jet recording apparatuses are widely used as apparatuses for recording an image on a recording medium. In forming an image using an ink jet recording apparatus, a heater which is provided in a nozzle in a recording head is heated and a bubble is instantaneously generated by the heat. Then, under the pressure of the bubble, ink is discharged from a discharge port of the nozzle. Generally, ink in the nozzle of the ink jet recording apparatus thickens as time passes and tends to fix to the nozzle. This causes defective discharge such as nozzle clogging and impact deviation. Further, ink cannot be discharged from the nozzle when a bubble is gradually generated in the ink discharge nozzle. This also causes the defective discharge. When the defective discharge occurs, color irregularity or density non-uniformity appears in streaks on the recording image.

When the defective discharge occurs, the mode of the recording apparatus is changed to a head cleaning mode and the head is recovered by cleaning processing. According to the cleaning processing, preliminary discharge operation or forced suction is performed. When the preliminary discharge operation is performed, ink is discharged from the nozzle for the purpose other than image recording. When the suction operation is performed, the clogged ink is forcibly removed and discharged under suction. However, since waste ink is produced according to these operations, the running costs of the recording apparatus are increased.

Further, if a large bubble that involves a plurality of nozzles is generated in the recording head or in the ink flow path, the bubble may not be removed by the above-described preliminary discharge operation or the suction operation. Japanese Patent Application Laid-Open No. 9-11496 discusses a method for removing such a bubble by circulating ink from an ink tank through an ink supply flow path by, for example, a pump. Owing to the ink circulation, the bubble in the ink flow path is drawn in the ink tank and the ink can be discharge normally again.

On the other hand, in some cases, paper dust and airborne undesired substance (hereinafter referred to as a "dust particle") adheres to the nozzle face. When the dust particle adheres to the nozzle face, the impact accuracy of the ink droplet is decreased and a streak is generated on the image formed under the defective discharge state. It is difficult to remove all the dust particles by the above-described preliminary discharge operation and the suction operation. A known method for removing such a dust particle is using the wiping mechanism. By using an elastic blade, the nozzle face is wiped and the dust particle is removed.

Although the method discussed in Japanese Patent Application Laid-Open No. 9-11946 is effective in recovering the defective discharge due to a bubble by circulating ink, it is not effective in recovering the defective discharge due to an adhering dust particle. On the other hand, although the adhering dust particle can be removed by blade wiping, it is not effective when the defective discharge is caused by a bubble.

SUMMARY OF THE INVENTION

The present invention is directed to an ink jet recording apparatus which is capable of efficiently recovering defective discharge due to a bubble as well as defective discharge due to a dust particle, and reducing the amount of waste ink.

According to an aspect of the present invention, an inkjet recording apparatus includes a recording head including a nozzle face on which a plurality of nozzles for discharging ink is formed, an ink tank configured to store ink to be supplied to the recording head, an ink circulation mechanism configured to circulate ink between the recording head and the ink tank, a wiping mechanism configured to wipe the nozzle face, an acquisition unit configured to acquire information concerning position of a defective discharge nozzle out of the plurality of nozzles, and a control unit configured to cause the ink circulation mechanism to perform an ink circulation operation or cause the wiping mechanism to perform a wiping operation. The control unit determines whether to execute the ink circulation operation or to execute the wiping operation based on the position information of the defective discharge nozzle acquired by the acquisition unit.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings. The components described below are exemplary and shall not be construed as limiting the present invention. In the description below, an ink jet printer is used as an example of a recording apparatus. According to the present invention, the "recording apparatus" is not limited to an apparatus dedicated to printing, and includes a multifunction peripheral including print functions and other functions or a manufacturing apparatus used for forming a pattern on a substrate or the like.

Figure 2:
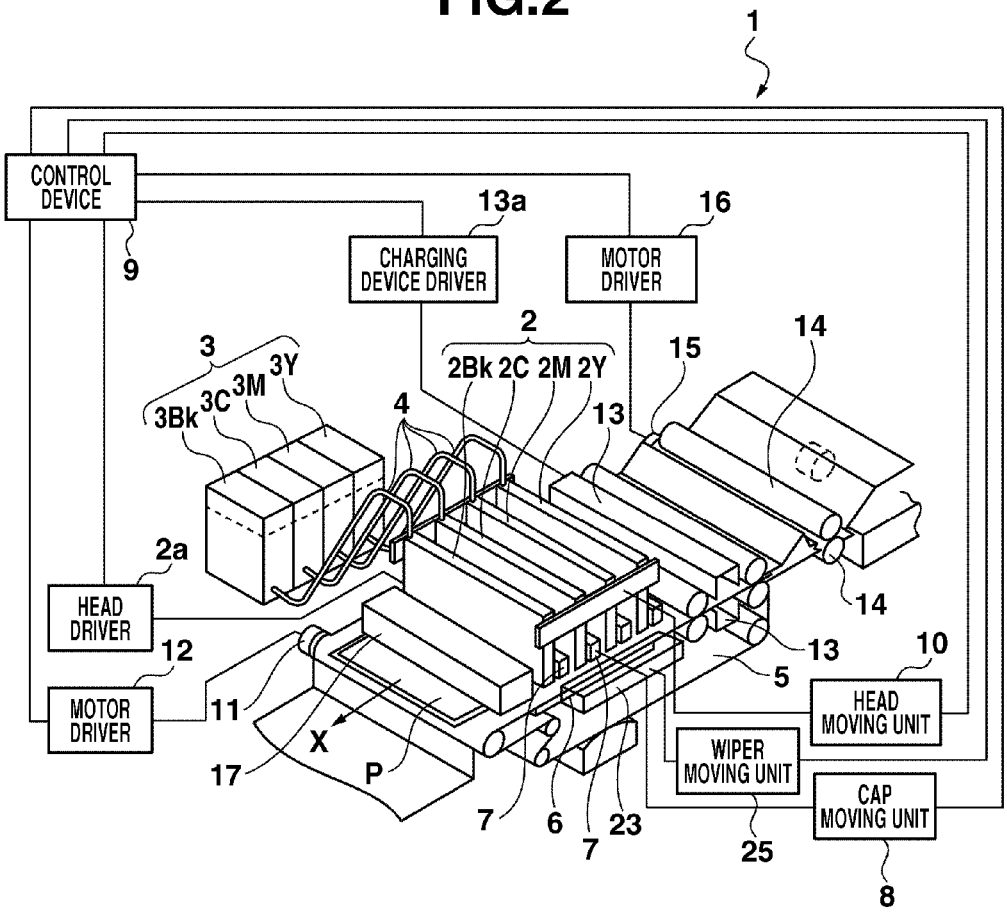
FIG. 2 illustrates a conceptual configuration of an ink jet recording apparatus.
Figure 3A:
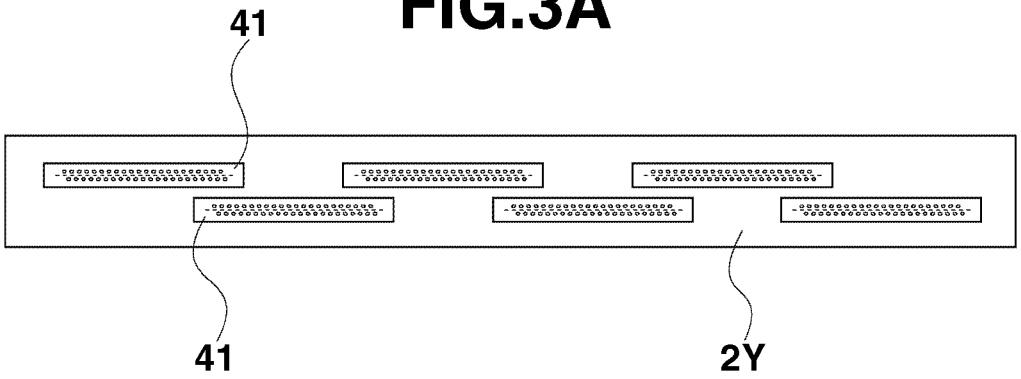
FIGS. 3A, 3B and 3C illustrate a configuration of a recording head.
Figure 3B:
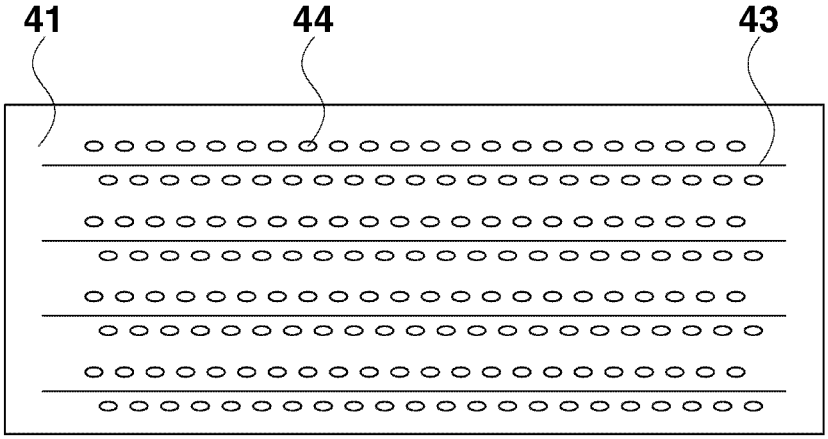
Figure 3C:
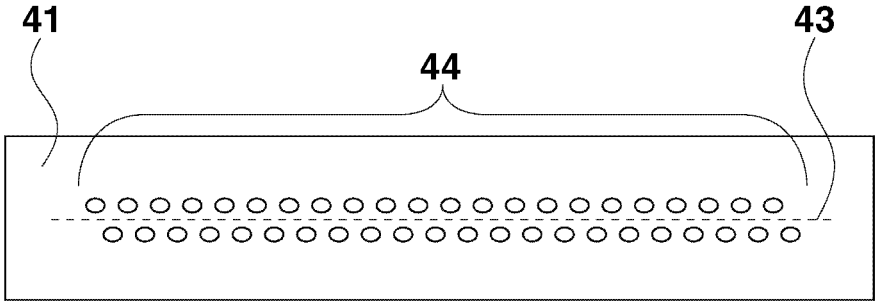

FIG. 2 illustrates a conceptual configuration of an ink jet recording apparatus according to a first exemplary embodiment of the present invention. FIGS. 3A to 3C schematically illustrate plan views of a recording head arranged in an array.

An ink jet recording apparatus 1 according to the present embodiment is a full-line color ink jet recording apparatus including a plurality of long recording heads 2Y, 2M, 2C, and 2Bk that extend in the direction orthogonal to the conveying direction of a recording medium. The recording heads 2Y, 2M, 2C, and 2Bk discharge yellow ink, magenta ink, cyan ink, and black ink, respectively. The configuration of each recording head is substantially the same and the recording heads 2Y to 2Bk are collectively referred to as a recording head 2 if differentiation of the heads is not important.

Via ink supply paths 4, the recording heads 2Y, 2M, 2C, and 2Bk are connected to sub tanks 3Y, 3M, 3C, and 3Bk (hereinafter, collectively referred to as a sub tank 3) including yellow ink, magenta ink, cyan ink, and black ink, respectively. Each sub tank 3 has a head pressure difference of approximately 150 mm from an ink discharge face of the recording head 2, in other words, a face of a nozzle array 44 described below. More specifically, each sub tank 3 is provided approximately 150 mm below the face of the nozzle array of the recording head 2 in the vertical direction.

A control device 9 controls operations of a head driver 2*a*, a cap moving unit 8, a motor driver 12, a charging device driver 13*a*, a motor driver 16, a head moving unit 10, and a wiper moving unit 25 described below. First, the head moving unit 10 moves up/down in a facing direction with respect to a platen 6. The recording heads 2 are arranged along the conveying direction of a conveyance belt 5, so that the recording heads face the platen 6 with the conveyance belt 5 in between. The recording heads 2 are arranged at predetermined intervals. The recording head 2 includes a nozzle array 44, a liquid chamber 100, and an ink supply port. The nozzle array 44 includes ink discharge ports arranged in rows. The ink of the above-described sub tank 3 is supplied to the liquid chamber 100. The ink in the liquid chamber 100 is supplied to each ink discharge port via the ink supply port. Each row of nozzles includes a plurality of nozzles. Each nozzle includes an electrothermal conversion device (heater). The heater serves as a discharge energy generation unit that generates thermal energy used for discharging ink. Further, the heater is electrically connected to the control device 9 via the head driver 2*a*. The heater is turned on/off according to an on/off signal (discharge/non-discharge signal) transmitted from the control device 9.

A head cap 7 is provided on a side of each recording head 2. The head cap 7 is a half pitch offset with respect to the interval of the recording heads. The head cap 7 is used for recovery processing, which is performed prior to a recording operation of a recording medium P. The recovery processing is performed by discharging the ink, which is thickened in the ink flow path, from a discharge port of the recording head 2. The head cap 7 moves to a position directly under each recording head 2 according to the cap moving unit 8, and receives waste ink discharged from the ink discharge port. Further, a wiper unit 23 which wipes ink adhering to a discharge face of the recording head 2 is provided along an extension of the recording head 2 in the longitudinal direction. The wiper unit 23 is movable to a position directly under each recording head 2 according to the wiper moving unit 25. The wiper unit 23 wipes off the ink adhering to the nozzle face as it moves facing the nozzles that discharge ink.

The conveyance belt 5 that conveys the recording medium P is entrained over a drive roller which is connected to a belt drive motor 11. The operation of the conveyance belt 5 is changed according to the motor driver 12. Further, a charging device 13 is provided on the upstream side of the conveyance belt 5. The charging device 13 charges the conveyance belt 5 so that the recording medium P is in intimate contact with the conveyance belt 5. The charging device 13 is turned on/off according to the charging device driver 13*a*. A feed motor 15 is connected to a pair of paper rollers 14 used for supplying the recording medium P to the conveyance belt 5. The feed motor 15 rotates the paper rollers 14 and is turned on/off according to the motor driver 16.

In recording the recording medium P, first, each recording head 2 is moved upward away from the platen 6. Next, the head cap 7 is moved to a position directly under each recording head 2. After the recording head is subjected to the recovery operation by the wiper unit 23, the head cap 7 is moved back to the waiting position. Then, the recording head 2 moves toward the platen to the recording position. The conveyance belt 5 is driven at the time the charging device 13 is turned on. After the recording medium P is placed on the conveyance belt 5 by the paper rollers 14, a predetermined color image is recorded on the recording medium P by each recording head 2.

After the image is recorded, the discharge state is inspected by an inspection unit 17 using a line sensor having a resolution of, for example, 4800 dpi so that position information of a defective discharge nozzle can be acquired. The inspection unit 17 inspects and determines the discharge nozzle by recording a predetermined inspection pattern and reading out the pattern by a sensor, or by examining ink dots discharged from the nozzles by the sensor.

According to the acquired position information, the control device 9 selects and executes a mode appropriate for the recovery, calculates the number of the defective discharge nozzles, and also calculates the ratio of the defective discharge nozzles to the discharge nozzles.

In the description of the present embodiment below, a system that uses the yellow ink will be used as an example of the ink supply system.

<Recording Head>

FIG. 3A illustrates the recording head 2, which is a full-line recording head used for the ink jet recording apparatus 1, viewed from the side of the ink discharge port face according to the present embodiment. The recording head 2 in FIG. 3A is the recording head 2Y for the yellow ink and a recording head chip 41, which is described below, is arranged on the recording head 2Y. FIGS. 3B and 3C are enlarged examples of the recording head chip 41 including a plurality of rows of nozzles. Eight rows of nozzles are provided in the nozzle array of the chip in FIG. 3B. Two rows of nozzles are provided in the nozzle array of the chip in FIG. 3C. According to the present embodiment, the discharge port and the liquid path are collectively called a nozzle.

According to the present embodiment, the nozzle rows of the nozzle array 44 on the recording head chip 41 are arranged in a staggered manner and an ink supply port 43 are provided between the nozzle rows. The ink supply port 43, which is described below, communicates with the liquid chamber 100 illustrated in FIG. 5. The liquid chamber 100, which stores ink, is provided at one end of the nozzle rows and communicates with the nozzle rows. According to the present embodiment, a plurality of the recording head chips 41 are arranged to form the recording head 2 which is a long full-line recording head. In FIG. 3A, six recording head chips 41 are connected to form the recording head 2Y. Generally, the nozzle arrays of the recording head chips 41, which are provided in a staggered manner, is partially overlapping with each other so that a white or a black streak is not produced in a portion between the nozzle arrays.

If the recording head including a nozzle array which has eight rows of nozzles illustrated in FIG. 3B is used, recording processing corresponding to eight passes is performed in one relative scan of the recording medium. Similarly, if the recording head including a nozzle array which has two rows of nozzles illustrated in FIG. 3C is used, recording processing corresponding to two passes can be performed. Since a recording head whose discharge ports are arranged in a staggered manner is used in the present embodiment, the recording processing corresponding to two passes will be described.

For example, it is assumed that one row of nozzles provides discharge ports with a 1200 dpi (21 μm) pitch and the other row of nozzles, with the ink supply port 43 in between, provides discharge ports with the same pitch but is shifted 2400 dpi (10.6 μm). The recording processing of this configuration corresponds to two passes since one dot is produced by an application of 2 shots of a 5-pl ink droplet in a frame of 1200 dpi square (21 μm square). Since one dot is recorded by ink discharged from two nozzles, even if one nozzle is accidentally unable to discharge normally, occurrence of a defective image can be prevented. Now, a nozzle array including two rows of nozzles illustrated in FIG. 3C will be used in describing the present embodiment.

Figure 4:
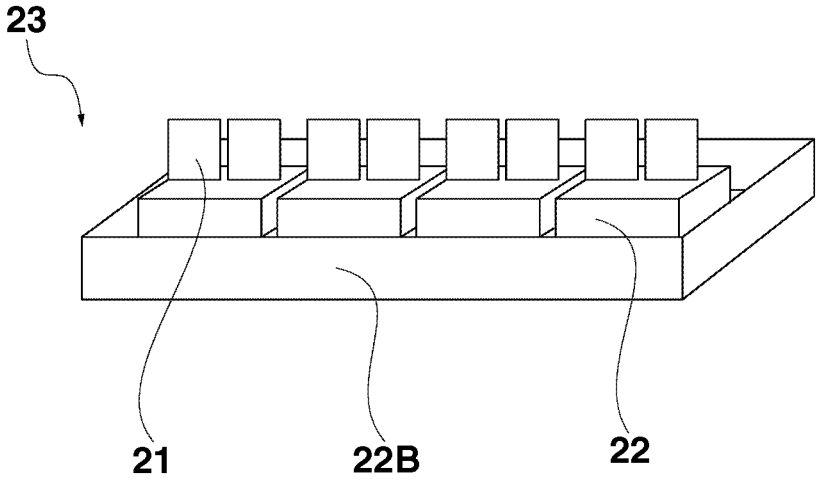
FIG. 4 illustrates a configuration of a wiper unit.

FIG. 4 illustrates a configuration of the wiper unit 23 used for cleaning the periphery of the nozzle rows of four recording heads, for example, for cleaning the above-described recording heads for yellow, magenta, cyan, and black ink. The wiper unit 23 includes a wiper base 22B and four pieces of wiper holders 22 are arranged on the wiper base 22B. Further, two wiper blades 21 are fixed to each of the wiper holders 22. The wiper blade 21 is made of rubber or resin. The two wiper blades are provided for each color corresponding to the recording head chips 41 arranged in a staggered manner.

<Ink Supply System>

Figure 5:
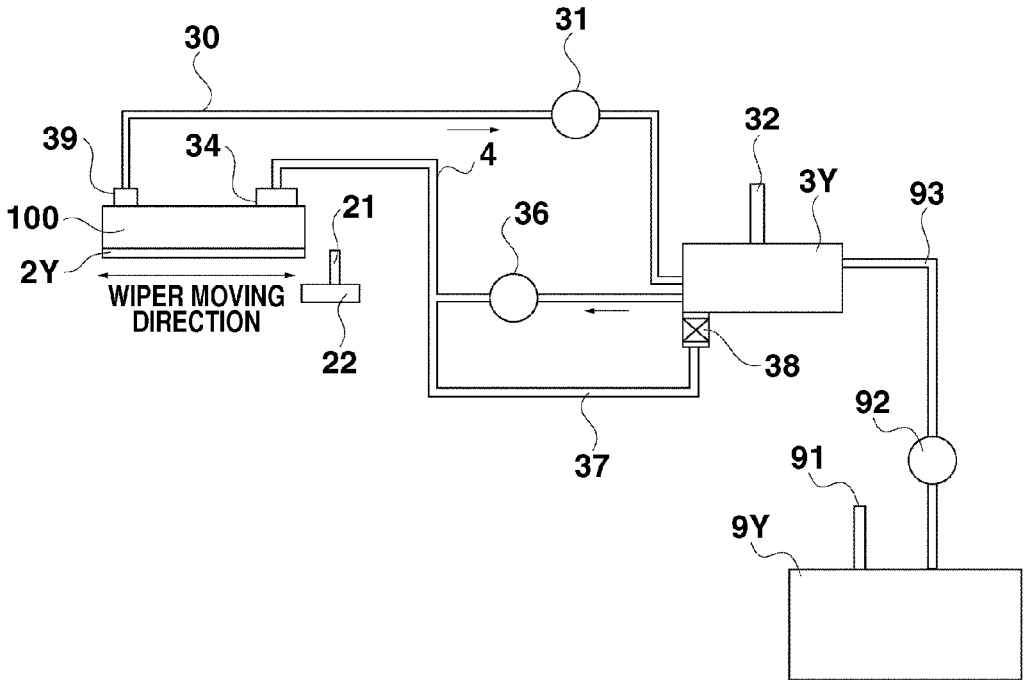
FIG. 5 illustrates a configuration of an ink supply system.

FIG. 5 illustrates a configuration of the ink supply system used in the ink jet recording apparatus 1 according to the present embodiment. FIG. 5 is an example of an ink supply system for yellow ink. The recording head 2Y includes the liquid chamber 100 that contains yellow ink. The sub tank 3Y includes an air communication port 32 by which the inside of the tank communicates with air. A supply port 34 includes a filter (not shown) through which the ink passes when the ink is supplied to the recording head 2Y. The supply port 34 is connected to the ink supply path 4.

A supply pump 36 is used for supplying ink to the recording head 2Y. An ink parallel supply path 37 is a parallel path connected to the ink supply path 4 and ink is supplied to the recording head 2 via the ink parallel supply path 37. Further, an on-off valve 38 is provided on the ink parallel supply path 37. Additionally, the ink supply system includes an ink reflux path 30 and a reflux pump 31 provided on the ink reflux path 30. The ink passes through the ink reflux path 30 when the ink in the recording head 2 is returned to the corresponding sub tank 3Y via a reflux port 39 having a filter of the recording head 2. The reflux pump 31 is used in returning the ink to the sub tank 3Y.

Next, the operation of the ink supply system according to the present embodiment will be described. First, a certain amount of ink (not shown) is supplied from an ink tank 9Y to the sub tank 3Y via a tube 93 by a supply pump 92. Next, the ink parallel supply path 37 and the ink reflux path 30 are filled with the ink. By setting a fill jig (not shown) in place of the recording head 2Y, and by driving the supply pump 36 while the on-off valve 38 provided on the ink parallel supply path 37 is open, the ink flows from the sub tank 3Y to the supply pump 36 and to the ink parallel supply path 37. Accordingly, the ink parallel supply path 37 is filled with the ink. When the ink parallel supply path 37 including the on-off valve 38 is filled with the ink, the supply pump 36 is stopped and the on-off valve 38 is closed.

Next, by driving the supply pump 36 and the reflux pump 31, the ink supply path 4 and the ink reflux path 30 are filled with the ink. Next, the fill jig is replaced with the recording head 2Y, and the recording head 2Y is filled with the ink. When the recording head 2Y is initially filled with the ink, the reflux pump 31 is driven in advance, and ink for physical distribution (not shown) in the liquid chamber 100 is discharged. The liquid changer communicates with the two rows of the nozzle array 44 and the ink supply port 43. The supply pump 36 is driven in such a manner that the flow balance between the reflux pump 31 and the supply pump 36 is appropriately adjusted, and air is not drawn into the inside by the nozzle array 44, and further, the ink does not leak from the nozzle array 44. According to such an operation, initial filling is performed while reducing the amount of waste ink produced by the nozzle array 44. When the bubble in the liquid chamber 100 is removed, the supply pump 36 and the reflux pump 31 are stopped.

Next, the ink (not shown) which is used for the ink jet recording is supplied to the recording head 2Y from the sub tank 3Y via the on-off valve 38, which is open, owing to the capillary attraction of each nozzle of the nozzle array 44. Then, an image is formed by an impact of 2 shots, at the maximum, of a 5-pl ink droplet in a square of 1200 dpi resolution.

<Ink Circulation and Pressure Application Recovery>

When the ink jet recording is continued for a long time, a bubble may be formed in the liquid chamber 100 due to dissolved air in the ink. Thus, it is desirable to periodically circulate the ink in the circulation flow path after the printing is completed. The ink circulation is performed by driving the reflux pump 31 while the on-off valve 38 is open and the supply pump 36 is stopped. The ink is supplied from the sub tank 3Y to the liquid chamber 100 after flowing through the ink parallel supply path 37 and the ink supply path 4 and via the supply port 34 of the recording head 2Y. The ink can be returned to the sub tank 3Y through the ink reflux path 30 via the reflux port 39.

Further, as a recovery method of the recording head 2Y, the supply pump 36 is operated such that pressure is applied to the inside of the liquid chamber 100 and the ink is discharged from a plurality of nozzle rows of the nozzle array 44 of the recording head chip 41 on the recording head 2Y. This pressure application recovery can be performed by driving the supply pump 36 while the on-off valve 38 is closed and the reflux pump 31 is turned off.

When the supply pump 36 is turned on, the ink is supplied from the sub tank 3Y to the liquid chamber 100 via the supply pump 36 and the supply port 34 of the recording head 2Y. At that time, since the reflux pump 31 is not operating, the ink does not flow into the ink reflux path 30 via the reflux port 39 of the recording head 2Y. The ink, however, can be discharged from a plurality of nozzles of the nozzle array 44 of the recording head chip 41 on the recording head 2Y. However, since a considerable amount of ink is discharged from the nozzles, it is desirable not to perform the pressure application recovery unless necessary.

Next, an issue of the ink jet recording apparatus according to the present embodiment will be described. When the recording is performed using the above-described apparatus, dust in the air or paper dust produced from roll paper (not shown) may attach to the vicinity of the nozzle array 44 of the recording head 2Y. Normally, the dust is removed together with the ink when the ink is discharged. However, defective discharge may occur depending on the amount of the dust and cause a defective image.

The recording head according to the present embodiment takes two shots of a 5-pl ink droplet in a frame of 1200 dpi square in forming one dot. This substantially amounts to a two-pass method. Thus, even if defective discharge nozzles are accidentally generated, the possibility of a defective image will be low if the nozzles are not consecutive nozzles. However, if defective discharge in two consecutive nozzles or more occurs, then a defective image will be formed. This is described in detail below referring to FIG. 7.

Figure 7A:
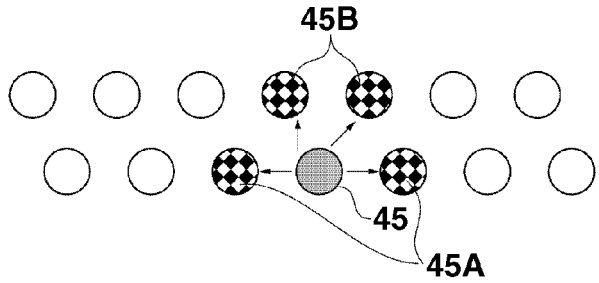
FIGS. 7A, 7B, 7C and 7D illustrate adjacent nozzle rows of a recording head, a dust particle attached to the nozzle, and a bubble generated in the ink.
Figure 7B:
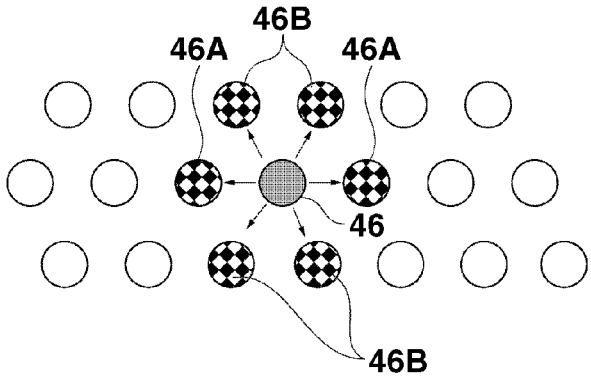
Figure 7C:
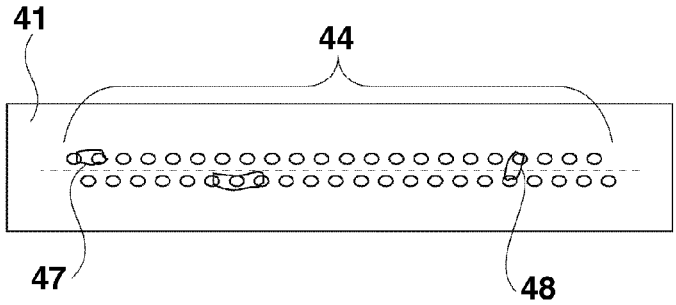

FIGS. 7A to 7C illustrate a nozzle array of a recording head. FIG. 7A illustrates a recording head including two rows of nozzles. In FIG. 7A, a focused nozzle 45 is a defective discharge nozzle. If defective discharge of the nozzles in the periphery of the focused nozzle 45 occurs, in other words, if discharge from nozzles 45A adjacent to the focused nozzle 45 in the same nozzle row, and adjacent nozzles 45B in the adjacent nozzle row are defective, then it will become consecutive defective discharge. Accordingly, a defective image will be generated. FIG. 7B illustrates a recording head including nozzles of 3 rows and a focused nozzle 46. In FIG. 7B, if defective discharge of the nozzles in the periphery of the focused nozzle 46 occurs, in other words, if discharge from adjacent nozzles 46A in the same nozzle row as the focused nozzle 46, and adjacent nozzles 46B in the adjacent nozzle rows are defective, then it will be consecutive defective discharge. Accordingly, a defective image will be generated.

If the defective discharge is caused by an individual nozzle or a number of individual nozzles, solidification due to ink thickening or a bubble is considered to have caused the defect. However, if discharge from a plurality of consecutive nozzles is defective as illustrated in FIGS. 7A and 7B, a dust particle or a large bubble is considered to have caused the defective discharge. This type of defective discharge will be described below.

First, a case where consecutive defective discharge of adjacent nozzles is caused due to a dust particle will be described referring to FIG. 7C. As illustrated in FIG. 7C, defective discharge due to a dust particle 47 adhering to adjacent nozzles in a same row of nozzles or a dust particle 48 that covers nozzles of adjacent rows of nozzle tend to cause a defective image. Thus, it is necessary to wipe such a dust particle such as paper dust by a wiper.

Figure 7D:
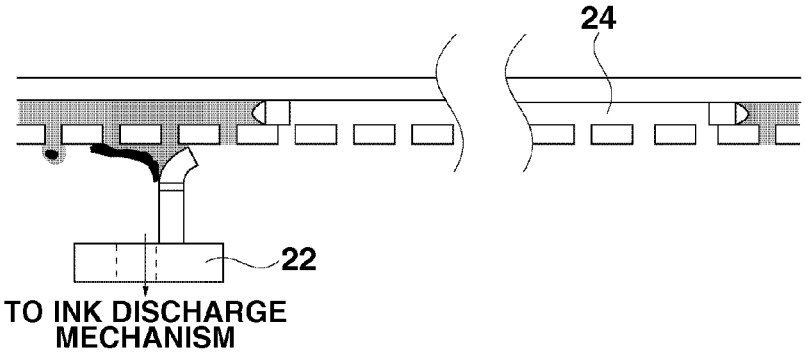

Next, a case where consecutive defective discharge of adjacent nozzles is caused due to a large bubble will be described referring to FIG. 7D. As illustrated in FIG. 7D, a large bubble 24 may be formed across the liquid chamber 100 to the ink supply ports 43 or across ports of a plurality of rows of the nozzle array 44 of the recording head 2. In this case, discharge of a great number of adjacent nozzles will be consecutively defective due to the bubble 24. Since the bubble 24 is generated inside the nozzles of the recording head, it cannot be removed even if the face of the nozzles is wiped by a wiper. However, it can be removed by the above-described ink circulation.

According to the present invention, whether the defective discharge has been caused by a dust particle or by a bubble is determined according to a state of the defective discharge nozzles. Then, according to the result of the determination, either the wiping mode or the ink circulation mode is selected. This processing is described in detail below.

Figure 1:
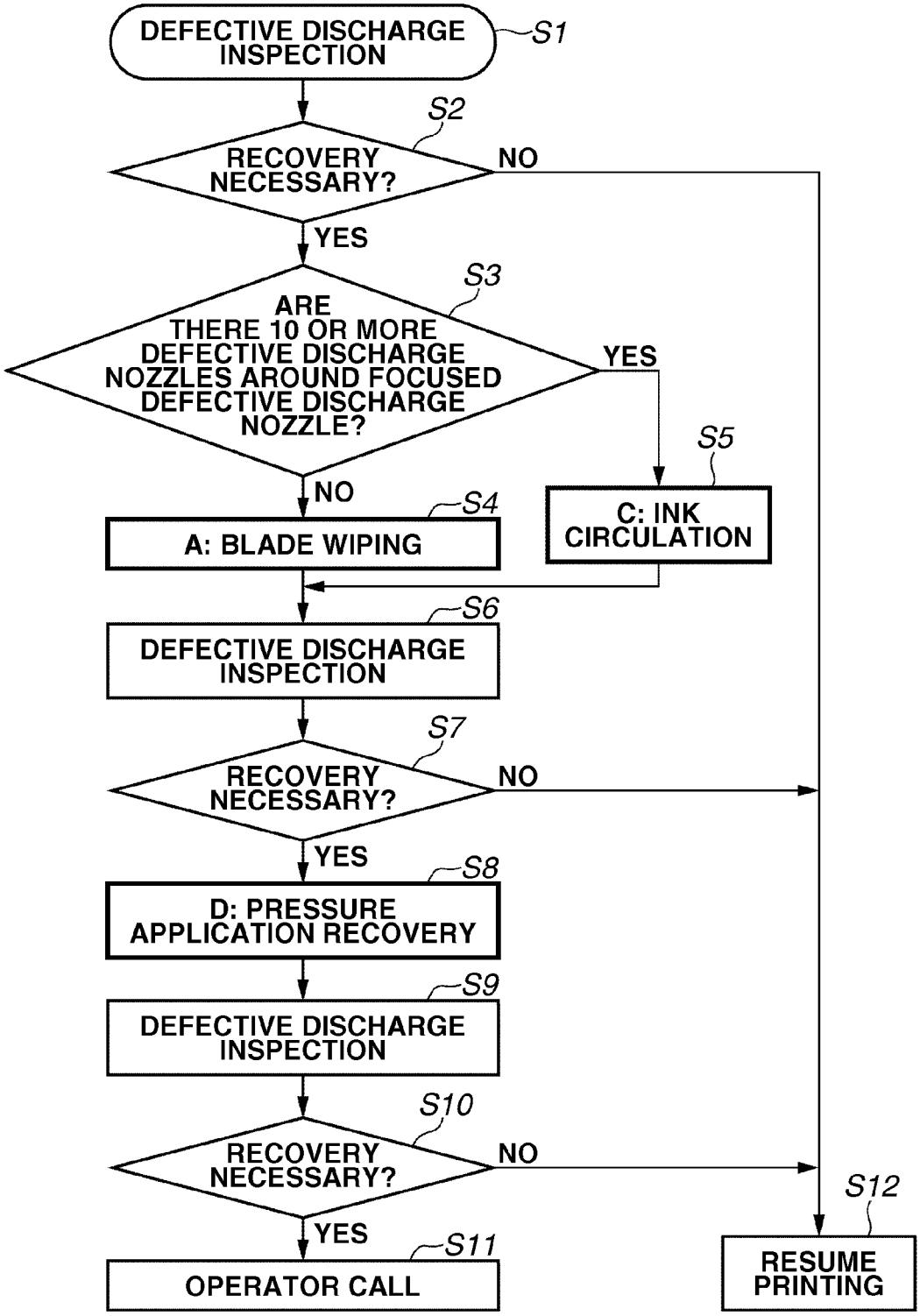
FIG. 1 is a flowchart illustrating a recovery method according to a first exemplary embodiment of the present invention.

FIG. 1 is a flowchart illustrating selection processing of a recovery method according to the present embodiment. In step S1, the control device 9 acquires position information of the defective discharge nozzle according to a defective discharge inspection performed by the inspection unit 17 and used for determining whether a defective discharge nozzle exists. In step S2, the control device 9 determines whether a recovery operation is necessary according to the acquired position information.

If, the defective discharge is not detected, or if the defective discharge is caused by an individual defective discharge nozzle or a number of such nozzles, in other words, if a defective discharge nozzle is not detected in the periphery of the focused defective discharge nozzle, the recovery operation is determined to be unnecessary (NO in step S2), and the processing proceeds to step S12. In step S12, the printing is resumed. On the other hand, if an adjacent nozzle of the focused defective discharge nozzle is determined to be defective, the recovery operation is determined to be necessary (YES in step S2), and the processing proceeds to step S3.

In step S3, the control device 9 determines whether the number of the defective discharge nozzle in the periphery of the focused defective discharge nozzle is 10 nozzles or more. As illustrated in FIGS. 7A and 7B, the number of the defective discharge nozzles in the periphery of the focused defective discharge nozzle is calculated. Further, all the defective discharge nozzles are considered as the focused defective discharge nozzles and a number of the defective discharge nozzles in the periphery of such nozzles will be calculated.

If the number of the defective discharge nozzles in the periphery of the focused defective discharge nozzle is less than 10 nozzles (NO in step S3), then the control device 9 determines that the discharge defect has been caused by a dust particle adhering to the recording head chip as illustrated in FIG. 7C, and the processing proceeds to step S4. In step S4, the dust particle is wiped by the wiper blade 21. On the other hand, if the number of the defective discharge nozzles in the periphery of the focused defective discharge nozzle is determined to be 10 nozzles or more (YES in step S3), the control device 9 determines that the discharge defect has been caused by the bubble illustrated in the above-described FIG. 7D, and the processing proceeds to step S5. In step S5, the ink circulation is executed. When the ink circulation is executed, the ink is circulated, for example, for two minutes.

In step S6, the defective discharge inspection is performed again. In step S7, the control device 9 determines whether the recovery operation is necessary based on whether two or more defective discharge nozzles are in the periphery of the focused defective discharge nozzle. If the recovery operation is determined to be unnecessary (NO in step S7), then the processing proceeds to step S12, and the printing is resumed. If the recovery operation is determined to be necessary (YES in step S7), then the processing proceeds to step S8. In step S8, the pressure application recovery is performed. When the pressure application recovery is performed, the ink is discharged from the nozzle array 44 according to the operation of the above-described supply pump 36. According to the present embodiment, the pressure application recovery is continued for 20 to 30 seconds.

In steps S9, the defective discharge inspection is performed again. In step S10, the control device 9 determines whether the recovery operation is necessary. If the recovery operation is determined to be unnecessary (NO in step S10), the processing proceeds to step S12, and the printing is resumed. If the recovery operation is determined to be necessary (YES in step S10), the processing proceeds to step S11. In step S11, intervention of an operator is requested.

As described above, according to the present embodiment, whether the cause of the defective discharge is a bubble or a dust particle is determined according to position information of a defective discharge nozzle. Then, according to a result of the determination, the wiping mode or the ink circulation mode is selected and executed. In this way, the defective discharge can be recovered. Further, by employing the above-described wiping and ink circulation methods, unnecessary waste ink can be reduced compared to when the recovery is performed by suction operation or preliminary discharge operation. As a result, the apparatus can efficiently recover from the defective discharge.

According to the present embodiment, ink of one color is used in the description. However, ink of six colors (i.e., light cyan and light magenta as well as yellow, magenta, cyan, and black) or more is used in the conventional recording apparatuses, and the configuration of the present embodiment is applicable to the ink supply system of each ink color, respectively.

Further, according to the present embodiment, if the defective discharge nozzles are independent nozzles, in other words, if they are not a plurality of adjacent defective discharge nozzles, the recovery operation is determined to be unnecessary. However, the determination of the present embodiment is not limited to such an example. In other words, the recovery operation can be performed if one defective discharge nozzle is detected.

Further, according to the present embodiment, the defective discharge is determined to have been caused by a dust particle or by a bubble according to whether the number of the defective discharge nozzle in the periphery of the focused defective discharge nozzle is a predetermined number or greater. However, the cause of the defective discharge is not necessarily determined according to such a numerical value. For example, since the defective discharge nozzle depends on the nozzle diameter and the nozzle pitch, the numerical value can be determined accordingly. Additionally, the range used in calculating the defective discharge nozzles in the periphery of the focused defective discharge nozzle can be determined according to the nozzle diameter and the nozzle pitch.

Further, according to the present embodiment, the number of the defective discharge nozzles in the periphery of the focused defective discharge nozzle is calculated based on the acquired position information of the defective discharge nozzles, and the number is used in determining whether the cause of the defective discharge is a bubble or a dust particle. The determination of the present invention, however, is not limited to such a method.

For example, if an area which is dense with the defective discharge nozzles is detected in the position information of the defective discharge nozzles, the defective discharge is determined to have been caused by a bubble and ink circulation will be performed. On the other hand, if an area which is not dense with the defective discharge nozzles is detected, the defective discharge is determined to have been caused by a dust particle and thus wiping will be performed. In determining the area, the nozzle array of the recording head may be divided into a plurality of blocks and position information of the defective discharge nozzles can be acquired for each block. Further, the cause of the defective discharge nozzles can be determined according to the distribution of the defective discharge nozzles or by calculating a ratio of the number of the defective discharge nozzles with respect to the number of the nozzles in the divided block.

In any of the above-described cases, if the number of the defective discharge nozzles is determined to be greater than or equal to a predetermined value, then the defective discharge is determined to have been caused by a bubble and the ink circulation is performed. If the value is determined to be less than the predetermined value, then the defective discharge is determined to have been caused by a dust particle and the wiping is performed. Further, if the maximum number of the number of the consecutive defective discharge nozzles in a same row of nozzles is greater than or equal to a predetermined number, for example 10 nozzles or more, the defective discharge can be determined to have been caused by a bubble. If the number of the consecutive defective discharge nozzles in a same row is smaller than the predetermined number, the defective discharge can be determined to have been caused by a dust particle. Further, if the distribution of the defective discharge nozzles is detected over a plurality of rows of nozzles with respect to a same nozzle number or consecutive nozzle numbers, the defective discharge is determined to have been caused by a bubble, and other cases are determined to have been caused by a dust particle.

According to the above-described exemplary embodiment, if the number of the defective discharge nozzles in the periphery of the focused defective discharge nozzle is less than 10 nozzles, the wiping mode is selected, and if the number of the defective discharge nozzles is 10 nozzles or more, the ink circulation mode is selected. If the problem persists after the wiping or the ink circulation is performed, then the pressure application recovery is performed. The blade wiping performed according to the first exemplary embodiment wipes the nozzle face without applying pressure to the ink. According to a second exemplary embodiment, the nozzle is recovered from the defective discharge using a different wiping method after the blade wiping used in the first exemplary embodiment is performed. When this wiping method is used, a smaller dust particle can be removed compared to the conventional wiping method. This new wiping method will be described with reference to FIG. 10.

Figure 10A:
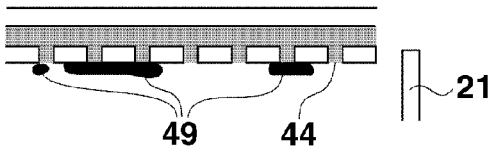
FIGS. 10A, 10B, 10C, 10D, 10E, 10F, and 10G illustrate blade wiping used in combination with pressure application.
Figure 10B:
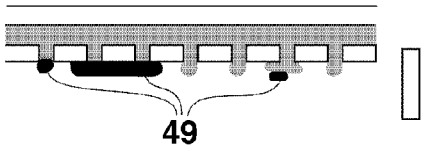

First, as illustrated in FIG. 10A, if a dust particle 49 is adhering to the nozzle array 44 of the recording head 2 when ink exists between the face of the nozzles and the dust particle 49, according to the interfacial tension of the ink, the dust particle 49 is strongly attracted to the nozzle. Further, since the ink in the nozzle maintains the negative pressure state due to head pressure caused by the height difference between the ink tank and the nozzle face of the recording head 2, a meniscus is formed.

Figure 10C:
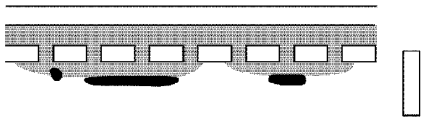
Figure 10D:
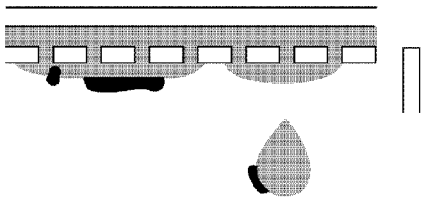

Then, as illustrated in FIG. 10C, if pressure is applied to the inside of the liquid chamber 100 by operating the supply pump 36, the ink overflows the nozzles of the recording head 2. At that time, the dust particle adhering to the nozzle face is removed together with the ink when the ink overflows, and stays in the ink that overflowed or at the interface between the ink and the air. If the application of the pressure is continued, the ink that overflowed a plurality of nozzles coalesces, and a large ink droplet that extends over a plurality of nozzles is formed. Then, some of the large ink droplets fall due to gravity as illustrated in FIG. 10D.

Figure 10E:
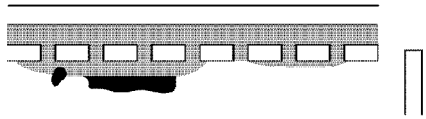
Figure 10F:
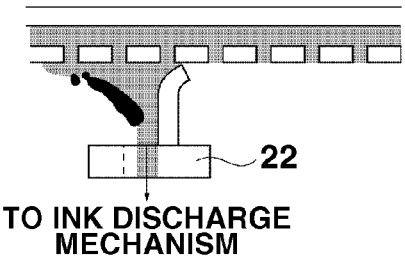

After then, the supply pump 36 is turned off and the application of pressure is stopped. When the application of pressure is stopped, since there is no head pressure caused by height difference between the ink tank and the nozzle face of the recording head, negative pressure is not applied to the recording head, and the nozzle face maintains the ink-overflowing state as illustrated in FIG. 10E. Then, as illustrated in FIG. 10F, the wiper blade 21 wipes the nozzle face of the recording head 2 according to the movement of the wiper holder 22. Since the dust particle 49 is in the ink that overflowed the nozzle face or at the interface between the ink and the air, it can be easily wiped off together with the ink that overflowed. The wiped ink and the dust particle 49 are collected by the wiper blade 21 and discharged to an ink discharge mechanism by the wiper holder 22.

Figure 10G:
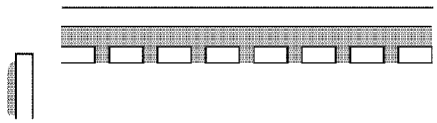

FIG. 10G illustrates a state of the nozzle face when the wiper blade 21 is moved to the end of the wiping position. All the dust particles 49 are removed from the nozzle face. Then, a meniscus is formed by turning on the supply pump.

By performing the above-described wiping, a dust particle which has been difficult to remove using the conventional blade wiping can be removed. Especially, if the nozzles are arranged at 1200 dpi, in other words, at 21 μm pitch, an undesired substance such as a skin fragment of 20 to 30 μm which may cover two adjacent nozzles can be lifted by the pressure applied from the side of the nozzle array 44. If the blade wiping is performed in that state, the dust particle can be removed. According to the present embodiment, this wiping method is referred to as "blade wiping combining pressure application".

Figure 6:
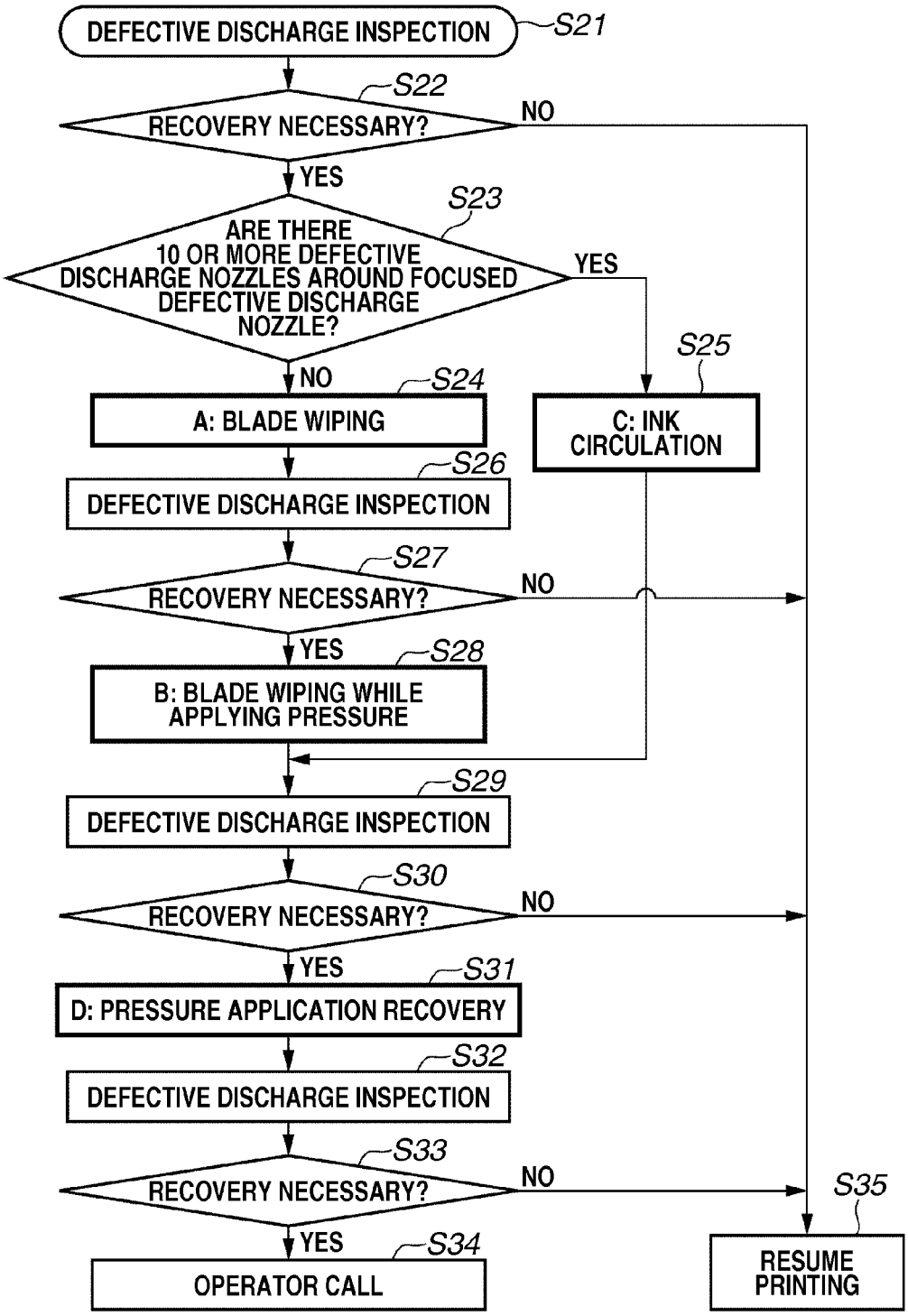
FIG. 6 is a flowchart illustrating the recovery method according to a second exemplary embodiment of the present invention.

An undesired substance such as a 20 to 30-μm skin fragment, which has been difficult to remove by the conventional blade wiping, can be removed at 600 dpi (42 μm) pitch. However, it cannot be removed as desired when it is 900 dpi (28 μm) pitch. According to the present embodiment, the user can select either a first wiping mode which is a wiping mode that does not apply pressure and a second wiping mode which is a blade wiping mode combining pressure application. FIG. 6 is a flowchart illustrating selection processing of a recovery method including the blade wiping combining pressure application according to the present embodiment.

In step S21, the control device 9 acquires position information of the defective discharge nozzle according to a defective discharge inspection performed by the inspection unit 17 and used for determining whether a defective discharge nozzle exists. As is with the first exemplary embodiment, if the defective discharge is not detected, or if the defective discharge is caused by an individual defective discharge nozzle or a number of such nozzles, the recovery operation is determined to be unnecessary (NO in step S22), and the processing proceeds to step S35. In step S35, the printing is resumed.

In step S22, if adjacent nozzles in the periphery of the focused defective discharge nozzle are defective, the recovery operation is determined to be necessary (YES in step S22), and the processing proceeds to step S23. In step S23, the control device 9 determines whether the number of the defective discharge nozzles in the periphery of the focused defective discharge nozzle is 10 nozzles or more.

If the number of the defective discharge nozzles in the periphery of the focused defective discharge nozzle is less than 10 nozzles (NO in step S23), the processing proceeds to step S24. In step S24, as is with the first exemplary embodiment, the first wiping mode is selected and the blade wiping operation by the wiper blade 21 is performed. In step S26, the defective discharge inspection is performed again.

In step S27, the control device 9 determines whether the recovery operation is necessary based on whether two or more defective discharge nozzles are in the periphery of the focused defective discharge nozzle according to the result of the defective discharge inspection. If the recovery operation is determined to be necessary (YES in step S27), then the processing proceeds to step S28. In step S28, the second wiping mode is selected and the above-described blade wiping combining pressure application is performed.

On the other hand, if the number of the defective discharge nozzles in the periphery of the focused defective discharge nozzle is determined to be 10 nozzles or more (YES in step S23), then the processing proceeds to step S25. In step S25, the ink circulation mode is selected and the ink circulation is performed. In step S29, the defective discharge inspection is performed again. In step S30, the control device 9 determines whether the recovery operation is necessary. If the recovery operation is determined to be unnecessary (NO in step S30), then the processing proceeds to step S35, and the printing is resumed.

If the recovery operation is determined to be necessary (YES in step S30), then the processing proceeds to step S31. In step S31, the pressure application recovery is performed as is with the first exemplary embodiment. In step S32, the defective discharge inspection is performed again. In step S33, the control device 9 determines whether the recovery operation is necessary. If the recovery operation is determined to be unnecessary (NO in step S33), the processing proceeds to step S35, and the printing is resumed. If the recovery operation is determined to be necessary (YES in step S33), the processing proceeds to step S34. In step S34, intervention of an operator is requested.

As described above, according to the present embodiment, whether the defective discharge is caused by a bubble or by a dust particle is determined based on the position information of the defective discharge nozzle. Then, the recovery mode is selected according to the result of the determination. Accordingly, the amount of unnecessary waste ink can be reduced and the defect can be efficiently recovered.

Further, according to the present embodiment, as is with the first exemplary embodiment, if the number of the defective discharge nozzles in the periphery of the focused defective discharge nozzle is smaller than a predetermined number (less than 10 nozzles according to the present embodiment), the dust is removed by normal blade wiping. If a dust particle cannot be removed by the normal blade wiping exists, the pressure application recovery is performed according to the first exemplary embodiment. However, according to the present embodiment, the blade wiping combining pressure application is performed before the pressure application recovery. Since airborne dust such as skin fragment can be removed without using the pressure application recovery, waste ink, which is produced when the pressure application recovery is performed, can be reduced, and operation time of the recording apparatus can be increased.

As is with the first exemplary embodiment, the method for determining whether the defective discharge has been caused by a bubble or by a dust particle is not limited to the above-described method. Further, according to the present embodiment, since there is a possibility that the ink drops from the head when the blade wiping combining pressure application is performed, the head cap 7 illustrated in FIG. 2 may be configured to stay under the wiper.

Figure 8:
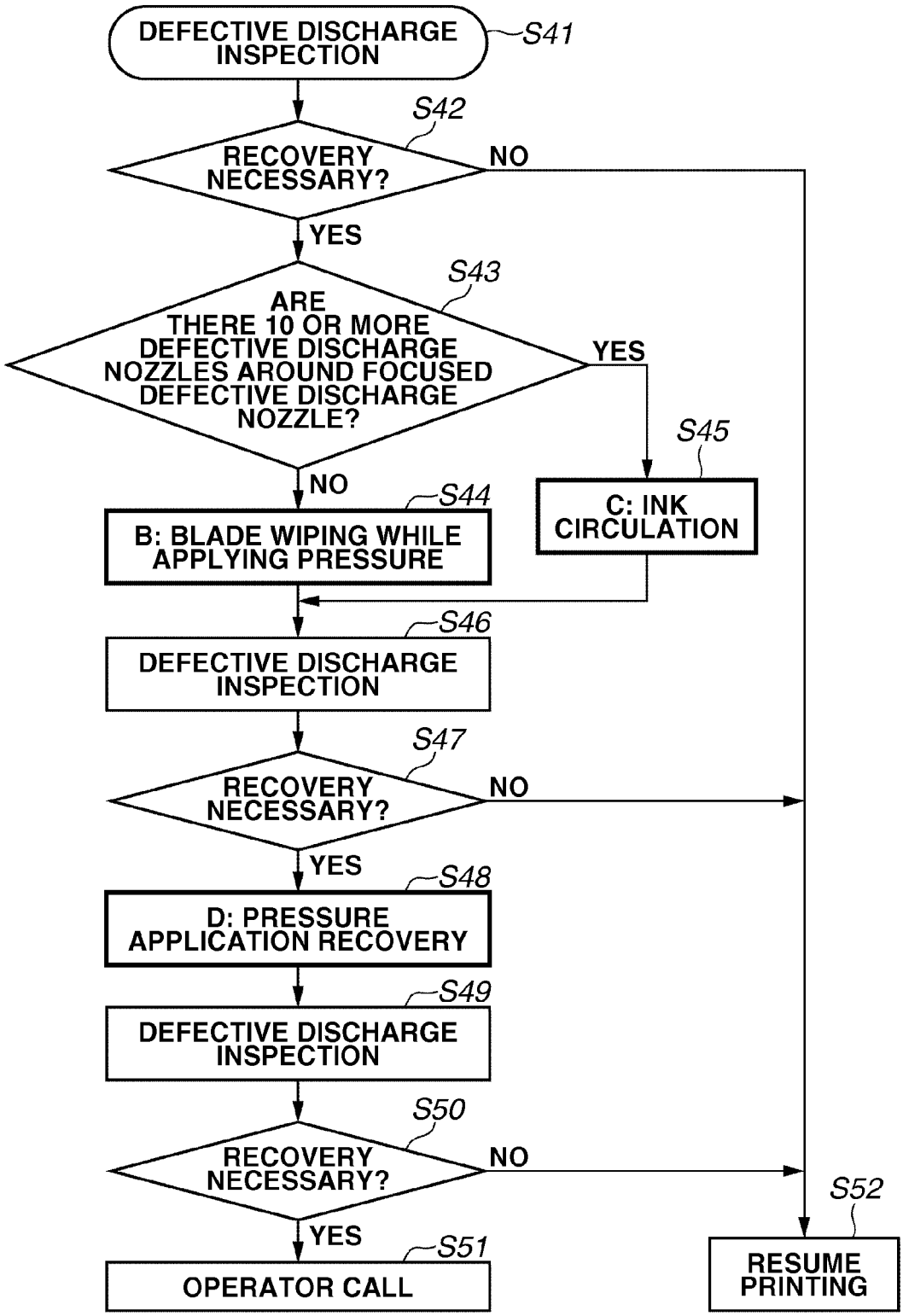
FIG. 8 is a flowchart illustrating the recovery method according to a third exemplary embodiment of the present invention.

Next, a third exemplary embodiment of the present invention will be described. FIG. 8 is a flowchart illustrating a recovery method according to the third exemplary embodiment. According to the present embodiment, the blade wiping combining pressure application used in the second exemplary embodiment is used in place of the normal blade wiping performed in step S4 in FIG. 1 of the first exemplary embodiment. According to this processing flow, the dust particle can be reliably removed in a short time and the amount of waste ink can be reduced compared to when the pressure application recovery is performed. Processing other than the blade wiping combining pressure application is similar to the processing described according to the first exemplary embodiment. Further, by performing the blade wiping combining pressure application, the number of times the determination is performed by the inspection unit 17 can be reduced. Thus, the operation time of the recording apparatus can be furthermore increased.

Figure 9A:
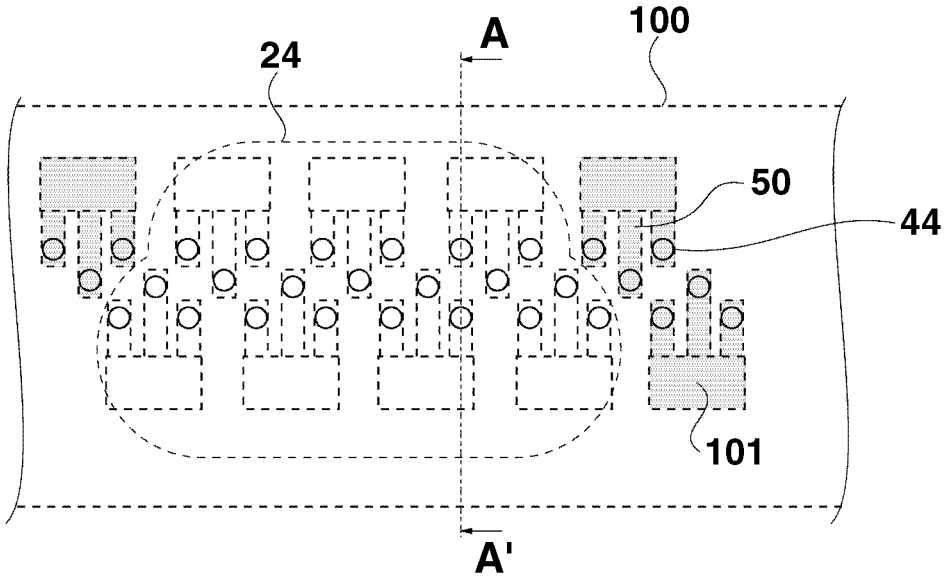
FIGS. 9A and 9B illustrate how a bubble is generated.
Figure 9B:
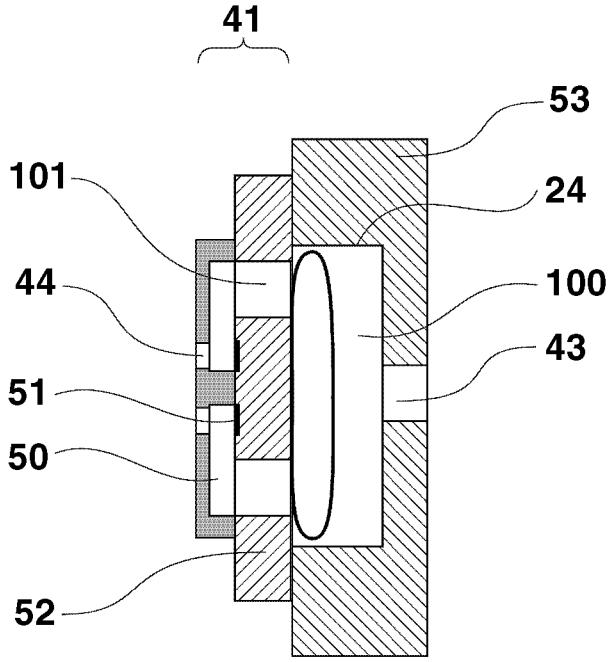

Next, a method according to a fourth exemplary embodiment for selecting either the ink circulation or the blade wiping when the recording head includes a liquid chamber which is common to the nozzles of a plurality of nozzle rows will be described with reference to FIGS. 9A and 9B. FIG. 9A illustrates the recording head chip viewed from the side of the discharge ports. FIG. 9B is a cross section of the recording head chip taken along line A-A' in FIG. 9A and viewed in the direction of the arrow. The ink supplied from the ink supply port 43 to the liquid chamber 100 common to the plurality of nozzles is supplied to a liquid chamber 101 in the recording head chip 41. The liquid chamber 101 is smaller than the liquid chamber 100.

The liquid chamber 101 communicates with three nozzles. The ink is supplied from the liquid chamber 101 to the discharge ports of the nozzles of the nozzle array 44 via a flow path 50. Then the ink is heated by a heater board 52 and discharged. If the bubble 24 is generated in the liquid chamber 100 as illustrated in FIG. 9, ink circulation becomes necessary since defective discharge of a plurality of nozzles occurs due to the bubble 24.

According to the first to the third exemplary embodiments, ink circulation is performed if the number of the defective discharge nozzles in the periphery of the focused defective discharge nozzle is greater than or equal to a predetermined value. According to the fourth exemplary embodiment, the ink circulation is performed if defective discharge nozzles of a predetermined number or more exist in a plurality of adjacent nozzle rows. In other words, if defective discharge occurs with respect to a plurality of adjacent nozzle rows, the defective discharge is determined to have been caused by a large bubble in the common liquid chamber 101. Generally, a nozzle number is assigned to each nozzle of the recording head. The number is assigned to the nozzle from one end of the nozzle row to the other end.

According to the present embodiment, if defective discharge nozzles having the same nozzle number or consecutive nozzle numbers over a plurality of nozzle rows exist, the defective discharge is determined to have been caused by a bubble and the ink circulation mode will be selected. The wiping mode can be selected from the first wiping mode that does not apply pressure and the second wiping mode using the blade wiping combining pressure application. Further, as is with the second exemplary embodiment, the second wiping mode can be executed after the first wiping mode.

According to the present embodiment, in nozzle rows of at least two adjacent rows of a recording head including a liquid chamber which is common to nozzles of a plurality of nozzle rows, it is determined whether defective discharge nozzles of a same nozzle number or consecutive nozzle numbers exist. If such defective discharge nozzles are detected, the defective discharge is determined to have been caused by a bubble. If such defective discharge nozzles are not detected, the defective discharge is determined to have been caused by a dust particle. Accordingly, the recovery method can be appropriately selected while reducing the amount of waste ink.

According to the exemplary embodiments of the present invention, an ink jet recording apparatus capable of efficiently recovering a defective discharge nozzle in a short time and reducing waste ink can be realized.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2009-213338 filed Sep. 15, 2009, which is hereby incorporated by reference herein in its entirety.

What is claimed is:

1. An inkjet recording apparatus comprising:

a recording head including a nozzle face on which a plurality of nozzles for discharging ink is formed;

an ink tank configured to store ink to be supplied to the recording head;

an ink circulation mechanism configured to circulate ink between the recording head and the ink tank;

a wiping mechanism configured to wipe the nozzle face;

a detection unit configured to detect, from among the plurality of nozzles, defective nozzles from which the ink is not discharged;

a control unit configured to control the ink circulation mechanism to perform an ink circulation operation, and an obtaining unit configured to obtain a number of the defective nozzles in an area around one of the defective nozzles detected by the detection unit, wherein the control unit controls the ink circulation mechanism to execute the ink circulation operation in a case the number of the defective nozzles is equal to or more than a predetermined number, and controls the wiping mechanism to execute the wiping of the nozzle face in a case the number of the defective nozzles is less than the predetermined number.

2. An inkjet recording apparatus according to claim 1, further comprising:

a pressure application unit configured to apply pressure to the ink in the nozzle, wherein the wiping operation includes a first wiping operation by which wiping is performed without using the pressure application unit and a second wiping operation which causes ink to which pressure is applied by the pressure application unit, to overflow the nozzle and wiping is performed after the application of the pressure to the ink performed by the pressure application unit is stopped.

3. An inkjet recording apparatus according to claim 1, further comprising:

a number calculation unit configured to calculate a number of the defective discharge nozzles that exist in a periphery of a focused defective discharge nozzle based on the position information of the defective discharge nozzle acquired by the acquisition unit, wherein the control unit causes the ink circulation mechanism to execute the ink circulation operation if the value acquired by the number calculation unit is greater than or equal to a predetermined value, and causes the wiping mechanism to execute the wiping operation if the value acquired by the number calculation unit is less than the predetermined value.

4. An inkjet recording apparatus according to claim 1, further comprising:

a ratio calculation unit configured to calculate a ratio of the defective discharge nozzles that exist in each of a plurality of blocks obtained by dividing the plurality of nozzles based on the position information of the defective discharge nozzle acquired by the acquisition unit, wherein the control unit causes the ink circulation mechanism to execute the ink circulation operation if the value acquired by the ratio calculation unit is greater than or equal to a predetermined value, and causes the wiping mechanism to execute the wiping operation if the value acquired by the ratio calculation unit is less than the predetermined value.

5. An inkjet recording apparatus according to claim 1, wherein the recording head includes a plurality of nozzle rows of the plurality of nozzles arranged on the nozzle face, wherein the control unit causes the ink circulation mechanism to execute the ink circulation operation if a maximum number of the consecutive defective discharge nozzles in a predetermined nozzle row out of the plurality of nozzle rows is greater than or equal to a predetermined number, and causes the wiping mechanism to execute the wiping operation if the maximum number is less than the predetermined number based on the position information acquired by the acquisition unit.

6. An inkjet recording apparatus according to claim 1, wherein the recording head includes a plurality of nozzle rows in which each of the plurality of nozzles is given a corresponding nozzle number for each nozzle row, and a liquid chamber which commonly communicates with the plurality of nozzles rows, and wherein the control unit causes the ink circulation mechanism to execute the ink circulation operation if defective discharge nozzles of a same nozzle number or consecutive nozzle numbers are in at least adjacent two rows of the nozzle rows out of the plurality of nozzle rows, and in other cases causes the wiping mechanism to execute the wiping operation based on the position information acquired by the acquisition unit.

7. The inkjet recording apparatus according to claim 1, wherein the plurality of nozzles are used for discharging a same type of ink.

8. The inkjet recording apparatus according to claim 1, wherein the ink tank and the recording head are connected to each other via at least two supply paths, and wherein the ink circulation mechanism circulates the ink using the at least two supply paths.

9. The inkjet recording apparatus according to claim 8, wherein the ink circulation mechanism is able to remove a bubble within the plurality of nozzles by circulating the ink.

10. The inkjet recording apparatus according to claim 1, wherein the wiping mechanism is able to remove a foreign particle adhering to the nozzle face by wiping the nozzle face.

11. The inkjet recording apparatus according to claim 1, wherein the detection unit detects a position of each of the defective nozzles, and wherein the obtaining unit obtains the number of the defective nozzles based on information of the position detected by the detection unit.

* * * * *